United States Patent [19]

Lohikoski

[11] Patent Number: 4,766,946

[45] Date of Patent: Aug. 30, 1988

[54] COMBINATION OF CASTING NOZZLES FOR CASTING BAR AND TUBULAR PRODUCTS VERTICALLY UPWARDS

[75] Inventor: Timo Lohikoski, Pori, Finland

[73] Assignee: Vertic Oy, Helsinki, Finland

[21] Appl. No.: 32,069

[22] Filed: Mar. 27, 1987

[51] Int. Cl.[4] ..... B22D 11/10

[52] U.S. Cl. ..... 164/421; 164/418; 164/439

[58] Field of Search ..... 164/418, 421, 459, 464, 164/465, 474, 483, 484, 437, 438, 439

[56] References Cited

U.S. PATENT DOCUMENTS 2,553,921 5/1951 Jordan ..... 164/421
3,746,077 7/1973 Lohikoski et al. ..... 164/421
4,531,569 7/1985 Fritscher ..... 164/421

FOREIGN PATENT DOCUMENTS 46810 of 1971 Finland .
46693 of 1971 Finland .
58-157552 9/1983 Japan ..... 164/418

*Primary Examiner*—Nicholas P. Godici
*Assistant Examiner*—Richard K. Seidel
*Attorney, Agent, or Firm*—Ladas & Parry

[57] ABSTRACT

A combination-use nozzle for continuous casting vertically upwards with or without vacuum, has a solidification pipe in a cooler in a fireproof thermal shield. To provide a simple and durable structure, the solidification pipe is short, with thin walls and manufactured of a known nozzle material. The melt is led into the solidification pipe by a conduit pipe manufactured of a fireproof material and having a wider inside cavity then the solidification pipe. An annular space between the solidification and conduit pipes at the thermal shield of the cooler has powder insulation. When only the lower end of the conduit pipe is immersed in a melt, the melt can be lifted into the solidification pipe by vacuum pressure in the solidification pipe, or when the conduit pipe is immersed in the melt up to the cooler, the melt can rise into the solidification pipe of itself.

6 Claims, 1 Drawing Sheet

COMBINATION OF CASTING NOZZLES FOR CASTING BAR AND TUBULAR PRODUCTS VERTICALLY UPWARDS

The invention relates to a continuous casting machine and, more particularly, a nozzle therefor.

Processes and machines for continuous casting have been under busy development during the last decades, especially those meant for production of continuous castings with small cross sections. In addition to so-called horizontally-working continuous casting machines, continuous casting machines working vertically upwards have been developed. The latter have many advantages over the former. Some continuous casting machines which work vertically upwards are disclosed in Finnish Patent Nos. 46,693 and 46,810.

The machine disclosed in Finnish Patent No. 46,693 is based on the idea of immersing a nozzle having a cooler with a thermal shield thereabout so deep in a metal melt that the melt rises inside the cooler to a solidification zone therein, where it solidifies. The solidified metal is removed from the solidification zone by pulling upwards at a suitable speed and then fed into coiling on other apparatuses.

The machine disclosed in Finnish Patent No. 48,810 is based on the idea of sucking a metal melt into a solidification zone of a nozzle above a free surface of the melt with an under-pressure. The solidified metal is removed from the solidification zone, after solidification, as described above.

Both of these machines therefore work in the same way, except for the way the melt is led into the solidification zone. This difference leads to their use for different operations. The first, using immersion, is more advantageous for casting hollow bodies, because maintaining suction for a hollow body would be difficult.

Both these machines have solved the problems of continuous casting vertically upwards in practical ways, but they still present some difficulties, which are eliminated in the present invention, thus making its way of casting more effective and more economical. Additionally, the nozzle structure presented here can be used in both the immersion and suction ways of the above machines and, therefore, is more versatile and more flexible to use, which gives the user a distinct technical advantage.

In vertical continuous casting, the solidification zone of the nozzle should be made of a material which is as compact and imporous as possible, and which can be ground so smooth that the still-weak structure of the metal skin of the melt just solidified will not break while gliding therealong. When using the suction process, the imporosity is also important to prevent outside gases from penetrating the nozzle. This nozzle material is generally compact graphite of good quality, although other materials could be considered.

The nozzle is a wearing part in continuous casting, because it is subject to abrasion by the solidified metal and corrosion by chemical reactions with the melt and/or matter dissolved therein, such as, e.g., oxygen. However, it is important that the inner surface of the solidification zone of the nozzle remains smooth and sleek. These high operational demands make the price of the nozzle material high. Therefore, it is necessary to try to make the part of the nozzle which is important for its proper operation (i.e., the solidification zone) as small as possible and to use cheaper materials in the other parts. This is partly the purpose of the invention.

Additionally, it has been noticed, in practice, that it is advantageous for the efficiency of casting, i.e., for its economy that the wall of the nozzle between the solidifying metal and the cooler, i.e., the wall of the solidification zone, be as thin as possible. From this, the heat conduction and, therefore, the solidifying speed, i.e., casting speed, are the best possible.

To try to design such a structure for the nozzles disclosed in the Finnish Patent Nos. 46,693 and 46,810 leads to great difficulties.

Specifically, in the nozzle according to Finnish Patent No. 46,810, the wall of the solidifying-zone portion ought to be thin, but the portion leading the melt thereto cannot have a thin wall, because it must mechanically resist the melt and suction pressure difference, too. (The suction pressure difference would draw outside gasses through the nozzle wall, which would corrode it faster the thinner it is.) Also, no great differences in thickness are possible between these portions because the interfaces where such portions meet would break up, because of mechanical forces, corrosion or thermal stresses, thus causing losses of nozzle material and operating troubles. In addition, it is unnecessary to use nozzle material of a high quality for leading melt to the solidification zone requiring such material; a coarser and cheaper material is enough for this purpose. But for the latter reason, material of quite different kinds from the melt lead-in zone, e.g., quartz glass or glazed crucible material, the use of which can be seen to be metallurgically better than the use of, e.g., graphite, for the sliding properties which are valuable in the solidification zone, cannot be considered.

Metal melts have small slag drops and gas bubbles, especially in induction melting furnaces, which cause it to whirl. In casting the melt vertically upwards, these try to rise into the nozzle, which would cause defects in the casting. In the present invention, this risk is eliminated by a special barrier plate to protect the lower part of the solidification zone.

In the process according to the Finnish Patent No. 46,693, i.e., in the so-called immersion vertical casting process, which is advantageous for casting tubular products, the solidification zone requires a certain durability to support a mandrel (for tubular casting) and resist the forces caused by tightening of the thermal shield.

In the present invention, the solidification zone is a pipe, which is freed from these other tasks; it only functions as a solidification zone. Melt is led to the solidification pipe by of a separate, meltconduit pipe and the mandrel is fastened on this separate, strong, melt-conduit pipe. The melt-conduit pipe is separate from the solidification pipe and fastened to or formed as an integral part of only a thermal shield about a cooler about the solidification pipe, and the portion of the thermal shield between the melt-conduit pipe and the solidification pipe is a powder material, e.g. graphite powder. As a result, the melt-conduit pipe can move with respect to the cooler (and the solidification pipe). The static pressure of the metal melt compacts the powder and prevents contact between the melt and the cooler.

The above-mentioned barrier plate is fastened on the melt-conduit pipe, which is movable relative to the cooler and solidification pipe. (The barrier plate can also be used for closing the solidification pipe before casting is started, whereby the parts to contact the melt have time to get heated to the working temperature.)

To start the casting, the melt-conduit pipe and the barrier plate fastened thereon are moved downwards, whereby casting can start over the entire periphery of the solidification pipe. For casting tubular products, a mandrel is fastened to the barrier plate, which mandrel thus can be moved up and down during the casting, wherefore the beginning of the casting can be facilitated as above, and then the thickness of the wall of the tubular product cast can be regulated. The latter is significant for casting pipes with thin walls; in the beginning, the wall can be cast thicker and then adjusted thinner after the casting has gotten started. With the present invention, it has been possible to cast, e.g., zinc pipe of 7 mm OD/5 mm ID, which may prove the usability of the invention.

The structure of the nozzle allows it to be used in operations according to both of the aboveidentified Finnish Patents, i.e., combination use.

The advantages mentioned above are achieved in that the solidification space comprises a short solidification pipe with thin walls manufactured of a nozzle material, e.g., compact graphite, and that the melt is led into the solidification pipe by a meltconduit pipe made of a fireproof material. The meltconduit pipe has a wider inside cavity than the solidification pipe. Because it is connected to the thermal shield of the cooler, only the lower part of the melt-conduit pipe is immersed in the melt (level a) to lift the melt into the solidification space by reduced (vacuum) pressure in the inside cavity of the solidification pipe, but when the nozzle is immersed in the melt up to the cooler (level b), the melt can rise to the solidification space by itself, i.e., according to the law of communicating vessels.

In the following, the invention will be described by means of the appended drawing, wherein.

Figure 1:
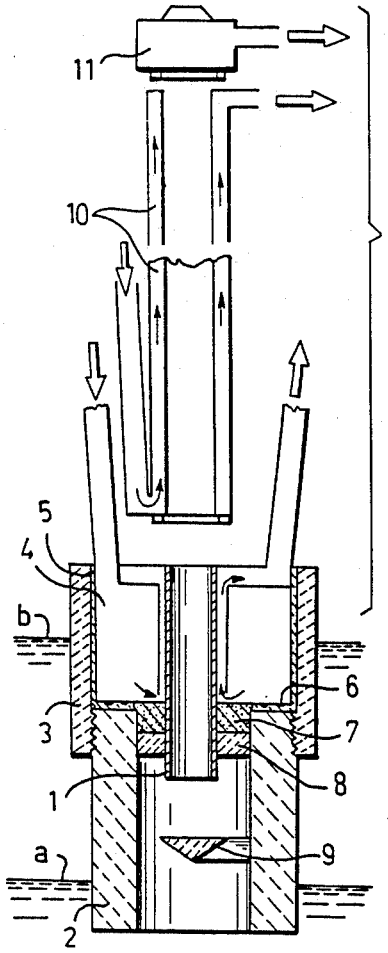
FIG. 1 is a cross-sectional elevation of a nozzle according to the invention in an exploded view with other devices of an operative unit.

The embodiments of both figures have a short solidification pipe 1 fastened in a cooler 4 for circulating water as indicated by the arrows. The solidification pipe can be manufactured of any suitable nozzle material, e.g. compact graphite. On the outer surface of the cooler, there is an insulating layer 5 with a protective shell 3 of a fireproof material, e.g. crucible material "Carborundum", thereabout. This can be made movable with respect to the cooler and provided with necessary control and moving devices.

A melt conduit pipe 2 is attached to the protective shell, either integrally or connected to it, e.g. by threads. Between the melt conduit pipe 2 and the lower surface of the cooler 4, the insulating layer 5 is elastic fireproof material (e.g. "Kaowool"), which is compacted to be gasproof by ring-shaped ridges 6 on the bottom of the cooler 4 when the conduit pipe 2 is pressed against the cooler 4 to prevent outside gases from coming into the inside of the conduit pipe 2.

The inside diameter of the conduit pipe 2 is bigger than the external dimensions of the solidification pipe 1 it is about. Axially successively in the annular space between them is graphite powder 7 and a ring 8 made of elastic fireproof material. The ring keeps the graphite powder in its place.

Figure 2:
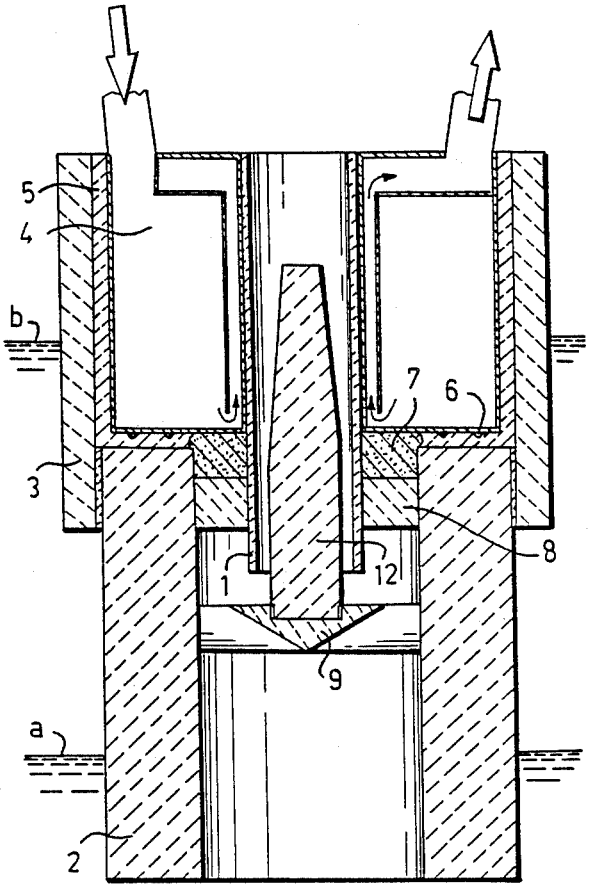
FIG. 2 is a cross-sectional elevation of another embodiment of a nozzle according to the invention on a larger scale than FIG. 1.

Inside the melt conduit pipe 2, there is a barrier plate 9, to which a mandrel 12 (FIG. 2) also can be fastened. The mandrel 12 extends upwards into the solidification pipe 1 and gets conically thinner.

All these parts together form an independent unit. It can be connected to an after-cooler 10 and to a vacuum ring 11 to form operative unit as shown only in FIG. 1.

In this structure, the solidification pipe 1 is freed from other tasks, wherefore it can be made as thin and short as possible. The melt is led into the solidification pipe by the conduit pipe 2, and the strains caused by the mandrel and barrier plate 9 are born by the conduit pipe 2, too. Further, the manufacture of a mandrel is also simple and saves raw materials; it can be made substantially only by turning, because it does not need to be provided with control shoulders or discharge channels for the melt. Furthermore, the melt can flow along the whole periphery of the solidification pipe, whereby the risk of premature solidification is small. Still furthermore, the mandrel is entirely independent of the solidification pipe, wherefore it can be used with solidification pipes of different sizes; it can be fastened to the barrier plate 9 with, for instance, threads. Still furthermore, the separate water circulation of the cooler 4 enables its separate adjustment to provide solidification as efficiently as possible. Still furthermore, the solidification pipe with its cooler and conduit pipe forms a light nozzle, which can be handled easily, e.g. when changing the solidification pipe.

In the drawings is also marked the surface level "a" of the melt when under pressure is used, whereby only the lower end of the conduit pipe 2 is immersed in the melt and the melt is lifted into the solidification pipe by suction. For this, and underpressure corresponding to a water column of 0.5–1.0 m is created in the inside of the nozzle. The surface level is "b" when immersion is used, whereby the melt rises to the corresponding level in the solidification pipe. Consequently, nozzle is for either, i.e. combination use. It can be connected to an after-cooler 10 with a vacuum source 11, whereupon only the lower end of the melt conduit pipe is immersed in the melt, or to an after-cooler without a vacuum source, whereupon the nozzle is immersed in the melt to the cooler.

What is claimed is:

1. A combination-use nozzle for continuous casting vertically upwards, comprising:

a solidification pipe;

a cooler about the solidification pipe so that one end of the solidification pipe projects from one end of the cooler;

a thermal shield abutting at least the one end of the cooler, the thermal shield being annularly spaced about the one end of the solidification pipe;

a melt-conduit pipe having one end abutting the thermal shield and surrounding the one end of the solidification pipe, the melt conduit pipe projecting farther than the one end of the solidification pipe projects from the cooler, the inside diameter of the melt-conduit pipe being larger than the external dimensions of the one end of the solidification pipe it is about, whereby to define an annular space therebetween;

a thermal-shield powder material in the annular space between the thermal shield and the one end of the solidification pipe and in the annular space between the melt-conduit pipe and the one end of the solidification pipe at least at the one end of the melt-conduit pipe; and means for keeping the thermal-shield powder material in the annular spaces thereof.

2. The combination-use nozzle of claim 1, wherein the thermal shield is movable relative to the cooler it is on.

3. The combination-use nozzle of claim 2, and further comprising:

a barrier plate on the inside of the melt-conduit pipe between the one end of the solidification pipe and the opposite end of the melt-conduit pipe; and a mandrel on the barrier plate and projecting to one end inside the one end of the solidification pipe.

4. The combination-use nozzle of claim 3, wherein the mandrel conically tapers away from the barrier plate toward the one end of the mandrel inside the solidification pipe.

5. The combination-use nozzle of claim 1, and further comprising:

a barrier plate on the inside of the melt-conduit pipe between the one end of the solidification pipe and the opposite end of the melt-conduit pipe; and a mandrel on the barrier plate and projecting to one end inside the one end of the solidification pipe.

6. The combination-use nozzle of claim 5, wherein the mandrel conically tapers away from the barrier plate toward the one end of the mandrel inside the solidification pipe.

* * * * *